US006508669B2

(12) United States Patent
Wang

(10) Patent No.: US 6,508,669 B2
(45) Date of Patent: Jan. 21, 2003

(54) SOCKET-AND-PLUG ASSEMBLY

(76) Inventor: Juei-Peng Wang, No. 177, Ta-Chiao 2nd St., Yung-Kang City, Tainan Hsien (TW)

( * ) Notice: Subject to any disclaimer, the term of this patent is extended or adjusted under 35 U.S.C. 154(b) by 0 days.

(21) Appl. No.: 10/022,756

(22) Filed: Dec. 13, 2001

(65) Prior Publication Data

US 2002/0127919 A1 Sep. 12, 2002

(30) Foreign Application Priority Data

Mar. 7, 2001 (TW) ..... 090203419 U

(51) Int. Cl.[7] ..... H01R 13/40

(52) U.S. Cl. ..... 439/598; 439/353; 439/354; 439/461

(58) Field of Search ..... 439/353, 354, 439/352, 357, 358, 682, 460, 461, 462, 598, 651

(56) References Cited

U.S. PATENT DOCUMENTS 4,611,878 A * 9/1986 Hall et al. ..... 439/353
6,116,945 A * 9/2000 Davis et al. ..... 439/354
6,296,508 B1 * 10/2001 Kuwahara et al. ..... 439/353

* cited by examiner

*Primary Examiner*—Tho D. Ta
(74) *Attorney, Agent, or Firm*—Akin, Gump, Strass, Hauer & Feld, L.L.P.

(57) ABSTRACT

A socket-and-plug assembly includes a socket member formed with a looped recess therein and a core that is surrounded by the looped recess and that is formed with a plurality of terminal passages. A latch member has an inserting end section inserted in the looped recess, and a resilient latch arm that is engageable with the socket member and that is resiliently pressable to disengage from the socket member. A plug member includes a terminal seat received snugly in the inserting end section, and a plurality of conductive terminals mounted in the terminal seat and received in the terminal passages, respectively.

5 Claims, 3 Drawing Sheets

SOCKET-AND-PLUG ASSEMBLY

CROSS-REFERENCE TO RELATED APPLICATION

This application claims priority of Taiwan patent Application No. 090203419, filed on Mar. 7, 2001.

BACKGROUND OF THE INVENTION

1. Field of the Invention

This invention relates to a socket-and-plug assembly, more particularly to a socket-and-plug assembly with a latch member for an electronic device.

2. Description of the Related Art

There has been a trend to provide electronic connecting ports for electrically connecting electronic devices, such as notebook computers, personal digital assistants, and mobil phones, in public areas or transport vehicles, such as airplanes and trains. The connecting ports normally include a socket member for receiving a plug member from the aforesaid electronic devices. It is important for the plug member to be securely retained by the socket member without being undesirably disassembed.

SUMMARY OF THE INVENTION

Therefore, the object of the present invention is to provide a socket-and-plug assembly with a latch member that is capable of securing a plug member to a socket member.

According to the present invention, a socket-and-plug assembly comprises: an insulator socket member including a cylindrical body that defines an axial direction and that has front and rear ends, the socket member further including a mating flange that extends outwardly from the rear end of the cylindrical body in a radial direction relative to the axial direction, the cylindrical body being formed with a looped recess that extends frontwardly from the rear end in the axial direction, and a core that is surrounded by the looped recess and that is formed with a plurality of spaced apart terminal passages which extend from the rear end in the axial direction, the mating flange defining a mating opening that is in spatial communication with the terminal passages, and having a top end that confines a top side of the mating opening, the top end of the mating flange having front and rear sides, and being formed with a bottom recess that extends from the front side to the rear side in the axial direction and that is in spatial communication with the mating opening; an insulator latch member including a hollow body that extends in the axial direction and that confines a plug receiving space, the hollow body having a top wall confining a top side of the plug receiving space, an inserting end section which is received fittingly in the looped recess, and a fastening end section which is opposite to the inserting end section, the latch member being formed with a latch receiving opening in the top wall between the inserting end section and the fastening end section, the latch receiving opening being defined by a peripheral wall that has a rear end adjacent to the fastening end section, the latch member further including an resilient latch arm that extends frontwardly from the rear end of the peripheral wall in the radial direction into the latch receiving opening and that has a hooking free end which is opposite to the rear end of the peripheral wall, which extends through the bottom recess in the top end of the mating flange, and which releasably engages the front side of the top end of the mating flange, the latch arm being resiliently pressable so as to permit disengagement of the hooking free end from the front side of the top end of the mating flange and so as to permit disassembly of the latch member and the socket member; and a plug member including an insulator plug housing and a plurality of conductive terminals mounted in and projecting outwardly from the plug housing in the radial direction. The plug member is insertable into the socket member in a manner such that the plug housing is received in the plug receiving space and that the terminals are respectively and fittingly received in the terminal passages.

BRIEF DESCRIPTION OF THE DRAWINGS

In drawings which illustrate an embodiment of the invention.

DETAILED DESCRIPTION OF THE PREFERRED EMBODIMENT

Figure 1:
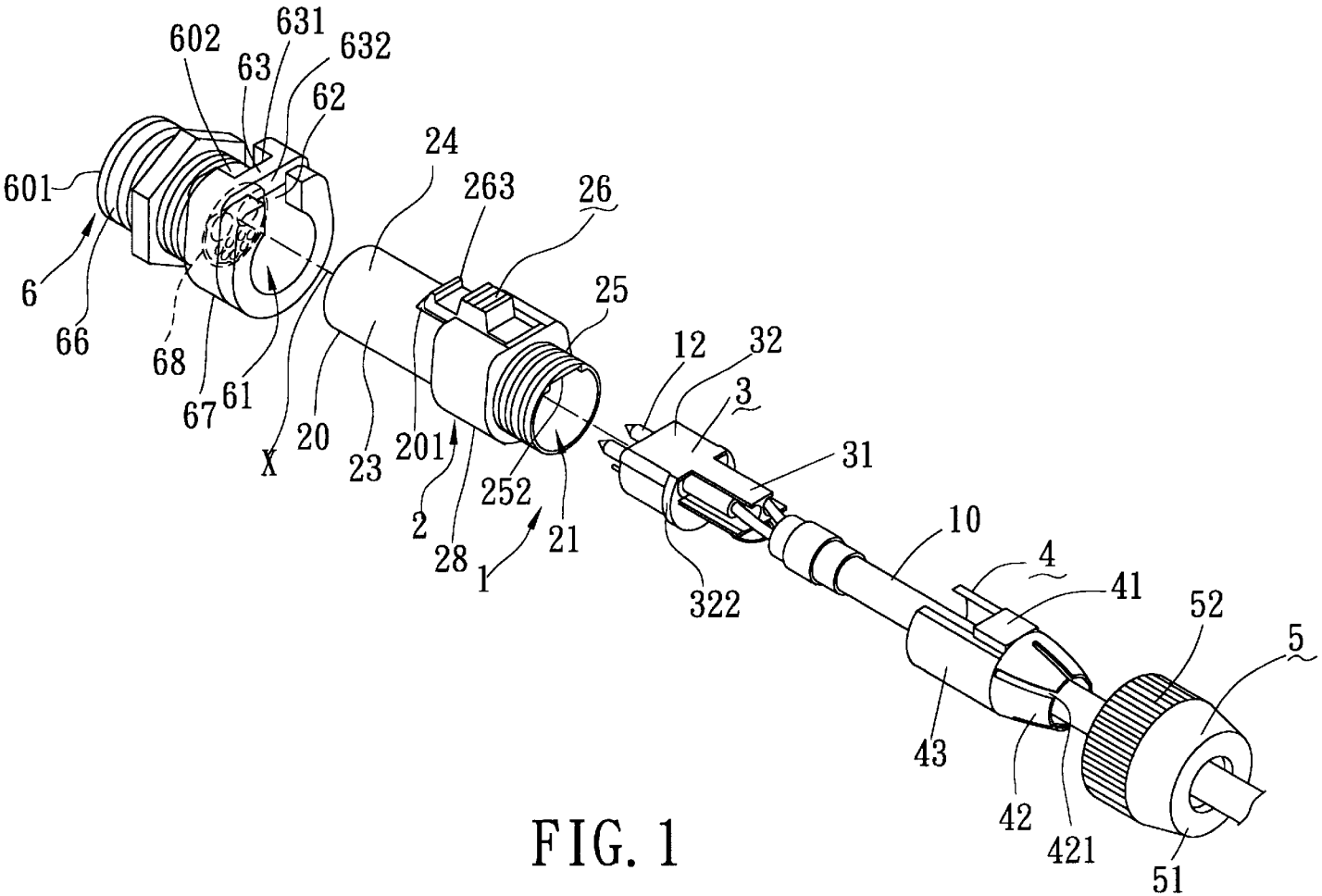
FIG. 1 is an exploded perspective view of a socket-and-plug assembly embodying this invention.
Figure 2:
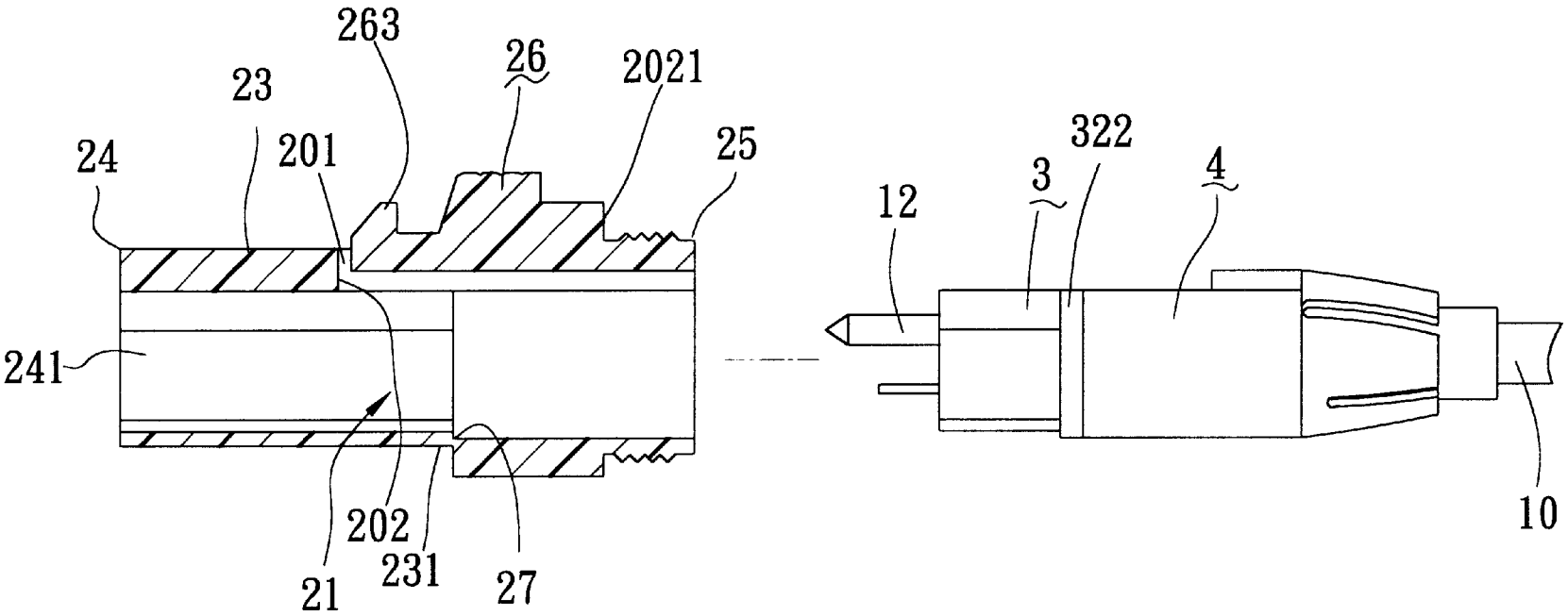
FIG. 2 is a sectional view showing a latch member of the socket-and-plug assembly of FIG. 1, and a plug member.
Figure 4:
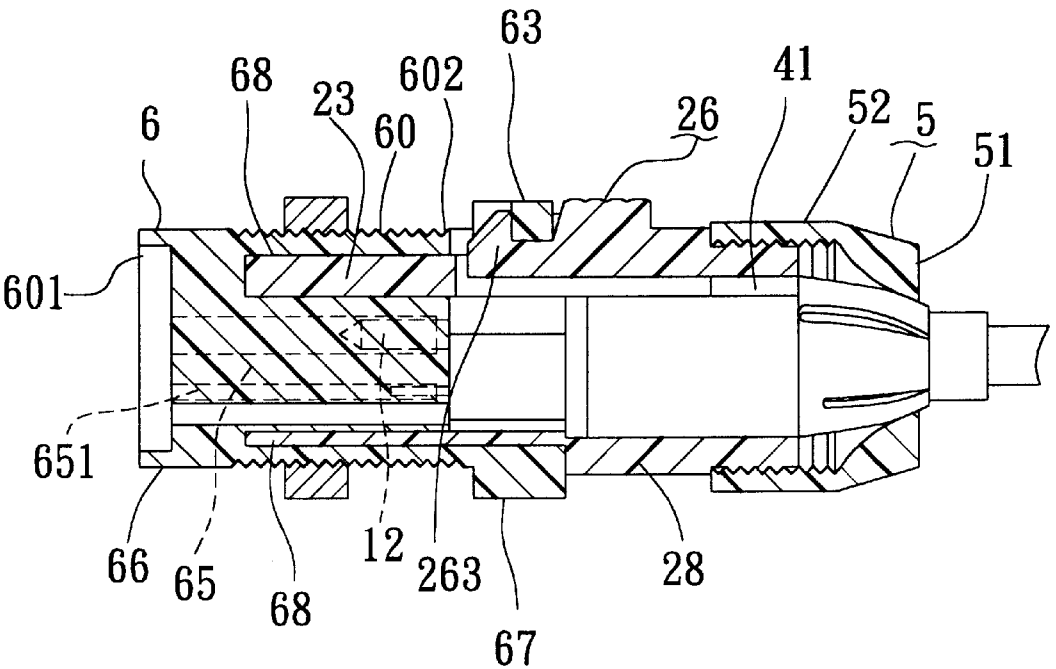
FIG. 4 is a sectional view of the socket-and-plug assembly of FIG. 1.
Figure 3:
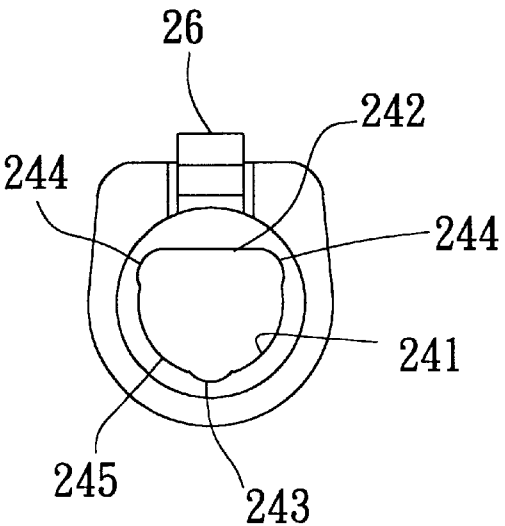
FIG. 3 is a front view of the latch member of FIG. 2.

FIGS. 1 and 4 illustrate a socket-and-plug assembly 1 embodying this invention for an electronic device.

The socket-and-plug assembly 1 includes: an insulator socket member 6 having a cylindrical body 66 that defines an axial direction (X), that is adapted to be securely inserted into a mounting hole of a connecting port (not shown), and that has front and rear ends 601, 602, the socket member 6 further including a mating flange 67 that extends outwardly from the rear end 602 of the cylindrical body 66 in a radial direction relative to the axial direction (X), and that is adapted to be exposed from the mounting hole of the connecting port, the cylindrical body 66 being formed with a looped recess 68 that extends frontwardly from the rear end 602 in the axial direction, and a core 65 that is surrounded by the looped recess 68 and that is formed with a plurality of spaced apart terminal passages 651 which extend from the rear end 602 in the axial direction (X), the mating flange 67 defining a mating opening 61 that is in spatial communication with the terminal passages 651, and having a top end 63 that confines a top side of the mating opening 61, the top end 63 of the mating flange 67 having front and rear sides 631, 632, and being formed with a bottom recess 62 that extends from the front side 631 to the rear side 632 in the axial direction (X) and that is in spatial communication with the mating opening 61; an insulator latch member 2 including a hollow body 20 that extends in the axial direction (X) and that confines a plug receiving space 21, the hollow body 20 having a top wall 24 confining a top side of the plug receiving space 21, an inserting end section 23 which is received fittingly in the looped recess 68, and a fastening end section 25 which is opposite to the inserting end section 23, the latch member 2 being formed with a latch receiving opening 201 in the top wall 24 between the inserting end section 23 and the fastening end section 25, the latch receiving opening 201 being defined by a peripheral wall 202 that has a rear end 2021 adjacent to the fastening end section 25, the latch member 2 further including a resilient latch arm 26 that extends frontwardly from the rear end 2021 of the peripheral wall 202 in the radial direction into the latch receiving opening 201 and that has a hooking free end 263 which is opposite to the rear end 2021 of the peripheral wall 202, which extends through the bottom recess 62 in the top end 63 of the mating flange 67, and which releasably engages the front side 631 of the top end 63 of the mating flange 67, the latch arm 26 being resiliently pressable so as to permit disengagement of the hooking free end 263 from the front side 631 of the top end 63 of the mating flange 67 and so as to permit disassembly of the latch member 2 and the socket member 6; and a plug member including an insulator plug housing 3 and a plurality of conductive terminals 12 mounted in and projecting outwardly from the plug housing 3 in the radial direction. The plug member is insertable into the socket member 6 in a manner such that the plug housing 3 is received in the plug receiving space 21 and that the terminals 12 are respectively and fittingly received in the terminal passages 651.

The inserting end section 23 is cylindrical in shape, and has a non-circular inner face 241 that has a top flat section 242 and a bottom curve section 245 interconnecting two opposite ends of the top flat section 242, and that is formed with at least a guiding groove 243 in the bottom curve section 245. The top flat section 242 cooperates with the bottom curve section 245 to define two opposing rounded corners 244 therebetween. The core 65 of the cylindrical body 66 has an outer face that conforms to the inner face 241 of the inserting end section 23. The looped recess 68 has a cross-section that conforms to that of the inserting end section 23 so that the inserting end section 23 can only be inserted into the looped recess 68 at an angle relative to the core 65. The plug housing 3 includes a terminal seat 32 that has an outer face conforming to the inner face 241 of the inserting end section 23 and that is snugly received in the inserting end section 23 of the hollow body 20 so as to enhance positioning of the plug member in the plug receiving space 21.

The hollow body 20 further includes an intermediate flange 28 that interconnects the inserting end section 23 and the fastening end section 25 and that extends outwardly from a rear end 231 of the inserting end section 23 in the radial direction so as to cooperate with the rear end 231 of the inserting end section 23 to define a shoulder 27 therebetween. The terminal seat 32 has front and rear ends. The plug housing 3 further includes a limiting flange 322 that projects from the rear end of the terminal seat 32 in the radial direction so as to engage the shoulder 27 and so as to limit the position of the terminal seat 32 in the inserting end section 23.

The plug housing 3 further includes a cable receiving seat 311 that extends rearwardly from the limiting flange 322 in the axial direction (X) for receiving a cable 10 therein. The fastening end section 25 of the latch member 2 has a threaded outer face, and a top wall that is formed with a bottom recess 252. The plug member further includes a sleeve 4 that has a front enclosing section 43 which is received in the plug receiving space 21 and which is sleeved on the cable receiving seat 311, a top positioning protrusion 41 which is snugly received in the bottom recess 252 in the top wall of the fastening end section 25, and a contractable binding end 42 which extends rearwardly from the front enclosing end 43 in the radial direction and which has a frusto-conical shape with a plurality of equiangularly spaced apart slits 421. The plug member further includes a nut 5 that has a front threaded end 52 which threadedly engages the threaded outer face of the fastening end section 25 of the hollow body 20, and a frusto-conical end 51 that extends rearwardly from the front threaded end 52 and that is sleeved on the binding end 42 so as to permit contraction of the binding end 42, which, in turn, permits the binding end 42 to be bound securely to the cable 10 that extends through the nut 5 and the sleeve 4, when the front threaded end 52 is driven to advance frontwardly along the fastening end section 25.

With the latch member 2, the plug member can be securely retained by the socket member 6.

With the invention thus explained, it is apparent that various modifications and variations can be made without departing from the spirit of the present invention. It is therefore intended that the invention be limited only as recited in the appended claims.

I claim:

1. A socket-and-plug assembly, comprising:

an insulator socket member including a cylindrical body that defines an axial direction and that has front and rear ends, said socket member further including a mating flange that extends outwardly from said rear end of said cylindrical body in a radial direction relative to said axial direction, said cylindrical body being formed with a looped recess that extends frontwardly from said rear end in said axial direction, and a core that is surrounded by said looped recess and that is formed with a plurality of spaced apart terminal passages which extend from said rear end in said axial direction, said mating flange defining a mating opening that is in spatial communication with said terminal passages, and having a top end that confines a top side of said mating opening, said top end of said mating flange having front and rear sides, and being formed with a bottom recess that extends from said front side to said rear side in said axial direction and that is in spatial communication with said mating opening;

an insulator latch member including a hollow body that extends in said axial direction and that confines a plug receiving space, said hollow body having a top wall confining a top side of said plug receiving space, an inserting end section which is received fittingly in said looped recess, and a fastening end section which is opposite to said inserting end section, said latch member being formed with a latch receiving opening in said top wall between said inserting end section and said fastening end section, said latch receiving opening being defined by a peripheral wall that has a rear end adjacent to said fastening end section, said latch member further including a resilient latch arm that extends frontwardly from said rear end of said peripheral wall in said radial direction into said latch receiving opening and that has a hooking free end which is opposite to said rear end of said peripheral wall, which extends through said bottom recess in said top end of said mating flange, and which releasably engages said front side of said top end of said mating flange, said latch arm being resiliently pressable so as to permit disengagement of said hooking free end from said front side of said top end of said mating flange and so as to permit disassembly of said latch member and said socket member; and a plug member including an insulator plug housing and a plurality of conductive terminals mounted in and projecting outwardly from said plug housing in said radial direction, said plug member being insertable into said socket member in a manner such that said plug housing is received in said plug receiving space and that said terminals are respectively and fittingly received in said terminal passages.

2. The socket-and-plug assembly of claim 1, wherein said inserting end section is cylindrical in shape, and has a non-circular inner face that has a top flat section and a bottom curve section interconnecting two opposite ends of said top flat section, and that is formed with at least a guiding groove in said bottom curve section, said core of said cylindrical body having an outer face that conforms to said inner face of said inserting end section, said looped recess having a cross-section that conforms to that of said inserting end section so that said inserting end section can only be inserted into said looped recess at an angle relative to said core.

3. The socket-and-plug assembly of claim 1, wherein said inserting end section is cylindrical in shape, and has a non-circular inner face that has a top flat section and a bottom curve section interconnecting two opposite ends of said top flat section, and that is formed with at least a guiding groove in said bottom curve section, said plug housing including a terminal seat that has an outer face conforming to said inner face of said inserting end section and that is snugly received in said inserting end section of said hollow body so as to enhance positioning of said plug member in said plug receiving space.

4. The socket-and-plug assembly of claim 3, wherein said hollow body further includes an intermediate flange that interconnects said inserting end section and said fastening end section and that extends outwardly from a rear end of said inserting end section in said radial direction so as to cooperate with said rear end of said inserting end section to define a shoulder therebetween, said terminal seat having front and rear ends, said plug housing further including a limiting flange that projects from said rear end of said terminal seat in said radial direction so as to engage said shoulder and so as to limit the position of said terminal seat in said inserting end section.

5. The socket-and-plug assembly of claim 4, wherein said plug housing further includes a cable receiving seat that extends rearwardly from said limiting flange in said axial direction, said fastening end section of said latch member having a threaded outer face, and a top wall that is formed with a bottom recess, said plug member further including a sleeve that has a front enclosing section which is received in said plug receiving space and which is sleeved on said cable receiving seat, a top positioning protrusion which is snugly received in said bottom recess in said top wall of said fastening end section, and a contractable binding end which extends rearwardly from said front enclosing end in said radial direction and which has a frusto-conical shape with a plurality of equiangularly spaced apart slits, said plug member further including a nut that has a front threaded end which threadedly engages said threaded outer face of said fastening end section of said hollow body, and a frusto-conical end that extends rearwardly from said front threaded end and that is sleeved on said binding end so as to permit contraction of said binding end when said front threaded end is driven to advance frontwardly along said fastening end section.

* * * * *